US010838321B2

(12) United States Patent
Minamoto

(10) Patent No.: US 10,838,321 B2
(45) Date of Patent: Nov. 17, 2020

(54) TONER CONTAINER AND IMAGE FORMING APPARATUS

(71) Applicant: KYOCERA Document Solutions Inc., Osaka (JP)

(72) Inventor: Riku Minamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/550,338

(22) Filed: Aug. 26, 2019

(65) Prior Publication Data

US 2020/0073285 A1 Mar. 5, 2020

(30) Foreign Application Priority Data

Aug. 28, 2018 (JP) ..... 2018-159727

(51) Int. Cl.
*G03G 15/08* (2006.01)

(52) U.S. Cl.
CPC ..... *G03G 15/0891* (2013.01); *G03G 15/0865* (2013.01)

(58) Field of Classification Search
CPC ..... G03G 21/1647; G03G 21/1676; G03G 15/0886; G03G 21/1857; G03G 21/1814; G03G 15/0891
See application file for complete search history.

(56) References Cited

U.S. PATENT DOCUMENTS 5,459,553 A * 10/1995 Kim ..... G03G 15/70 271/186
9,304,436 B2 4/2016 Eto
2004/0047651 A1* 3/2004 Koyama ..... G03G 15/0875 399/120
2013/0243491 A1* 9/2013 Nodera ..... G03G 15/0879 399/260
2016/0054678 A1* 2/2016 Eto ..... G03G 15/0865 399/262
2016/0062268 A1* 3/2016 Nakaue ..... G03G 15/0886 399/262
2017/0123347 A1* 5/2017 Shimizu ..... G03G 15/0865

FOREIGN PATENT DOCUMENTS

JP 2015-125333 A 7/2015

* cited by examiner

*Primary Examiner* — Walter L Lindsay, Jr.
*Assistant Examiner* — Jessica L Eley
(74) *Attorney, Agent, or Firm* — Studebaker & Brackett PC

(57) ABSTRACT

A toner container includes a container body containing a toner, a rotating member, a moving member, and a restricting mechanism. The container body has a discharging port discharging the toner. The rotating member is at least partly installed in the container body, engaged with an inner face of the container body, and rotated around a rotation axis extended in one direction. The moving member is attached to the rotating member, moved in the one direction in accordance with rotation of the rotating member, and conveys the toner in the container body to the discharging port. The restricting mechanism is provided in an engaging part of the rotating member and an inner face of the container body. The restricting mechanism allows rotation of the rotating member in a first rotating direction, and restricts rotation of the rotating member in a second rotating direction opposite to the first rotating direction.

12 Claims, 5 Drawing Sheets

TONER CONTAINER AND IMAGE FORMING APPARATUS

INCORPORATION BY REFERENCE

This application is based on and claims the benefit of priority from Japanese Patent application No. 2018-159727 filed on Aug. 28, 2018, the entire contents of which are incorporated herein by reference.

BACKGROUND

The present disclosure relates to a toner container and an image forming apparatus including this toner container.

Conventionally, an image forming apparatus of an electrographic manner supplies a toner from a developing device to an image carrier, such as a photosensitive drum, to thereby form a toner image. Such a toner used for forming of the toner image is generally replenished supplied from the toner container to the developing device. The toner container includes, for example, a container body having a discharging port discharging the toner and containing the toner, a rotating member installed in the container body and rotating around a rotation axis, and a moving member moving in accordance with rotation of the rotating member to convey the toner in the container body to the discharging port.

In the above-mentioned toner container, if a user rotates the rotating member in an opposite direction to an original rotating direction by mistake, the moving member is also moved in an opposite direction to an original moving direction. If such situation is caused, it is feared that distribution of the toner in the container body is varied, a stable quantity of the toner cannot be discharged from the discharging port, and toner replenishment from the toner container to the developing device becomes unstable.

SUMMARY

In accordance with an embodiment of the present disclosure, a toner container includes a container body, a rotating member, a moving member, and a restricting mechanism. The container body has a discharging port discharging a toner and contains the toner. The rotating member is engaged with an inner face of the container body, and is rotated around a rotation axis extended in one direction, and at least a part of the rotating member is installed in the container body. The moving member is attached to the rotating member, is moved in the one direction in accordance with rotation of the rotating member, and conveys the toner in the container body to the discharging port. The restricting mechanism is provided in an engaging part of the rotating member and an inner face of the container body. The restricting mechanism allows rotation of the rotating member in a first rotating direction, and restricts rotation of the rotating member in a second rotating direction opposite to the first rotating direction.

In accordance with an embodiment of the present disclosure, an image forming apparatus includes the above-mentioned toner container, and an attached member to which the toner container is detachably attached.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

First, the entire structure of an image forming apparatus 1 according to an embodiment of the present disclosure will be described.

Hereinafter, it will be described so that the front side of the image forming apparatus 1 is positioned at a left side on a paper sheet of FIG. 1. Arrows Fr, Rr, L, R, U and Lo in each of the drawings respectively indicate a front side, a rear side, a left side, a right side, an upper side and a lower side of the printer 1.

Figure 1:
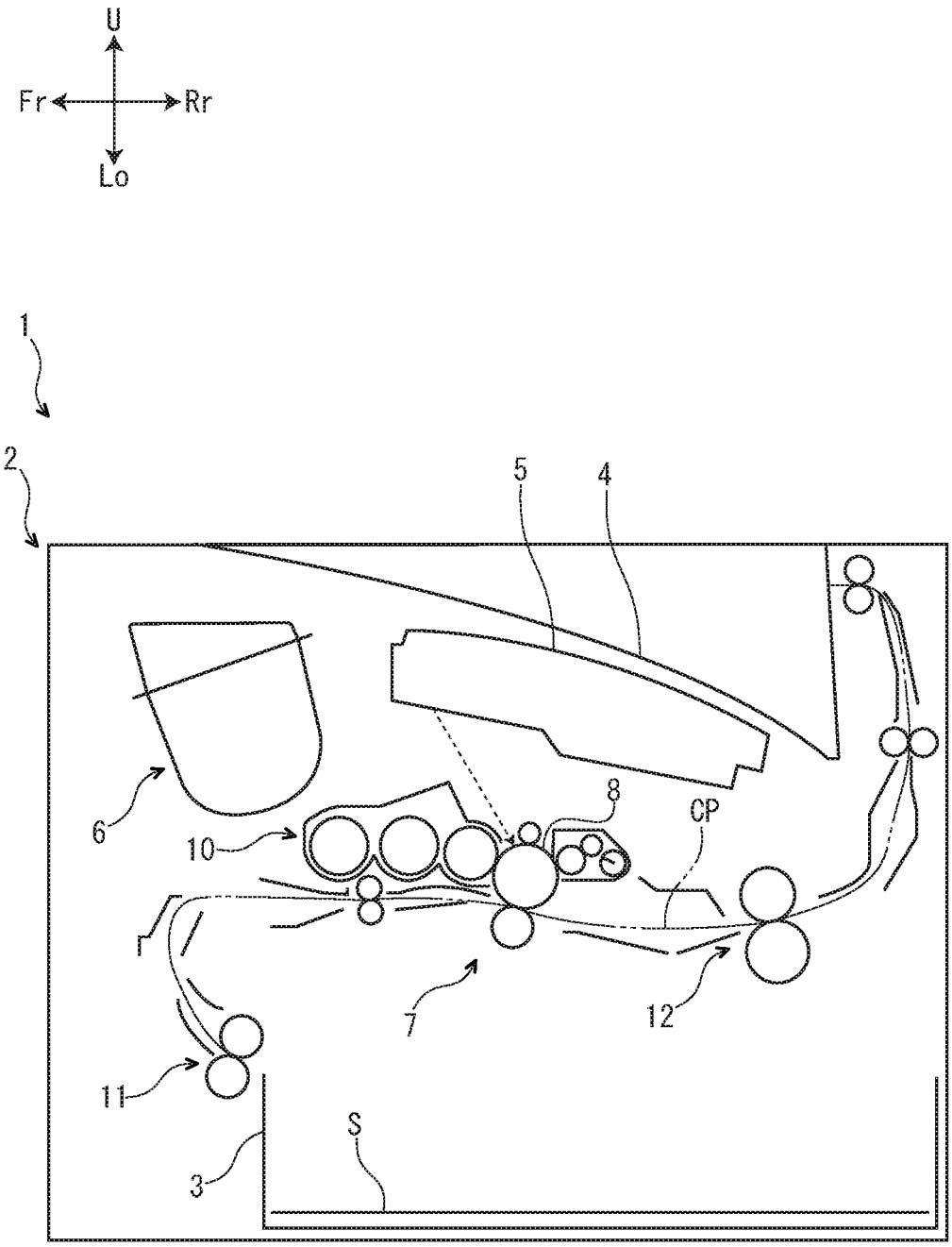
FIG. 1 is a sectional view schematically showing an image forming apparatus according to an embodiment of the present disclosure.

With reference to FIG. 1, the image forming apparatus 1 is, for example, a printer. The image forming apparatus 1 includes a box-shaped apparatus body 2. In a lower part of the apparatus body 2, a sheet feeding cartridge 3 storing sheets S (an example of a recording medium) is installed. In a top face of the apparatus body 2, an ejected sheet tray 4 is provided. In an upper part of the apparatus body 2, an exposure device 5 is installed below the ejected sheet tray 4. In an upper part of the apparatus body 2, a toner container 6 (an example of a toner containing case) is installed in front of the exposure device 5.

Inside the apparatus body 2, a conveying path CP for the sheet S is arranged. At an upstream end of the conveying path CP, a sheet feeding part 11 is provided. At an intermediate stream part of the conveying path CP, an image forming part 7 is provided. The image forming part 7 has a photosensitive drum 8 and a developing device (an example of an attached member). To the developing device 10, the toner container 6 is detachably attached. At a downstream part of the conveying path CP, a fixing device 12 is provided.

Next, image forming operation of the image forming apparatus 1 having such a configuration will be described.

First, by a laser light (refer to an arrow of a broken line in FIG. 1) from the exposure device 5, an electrostatic latent image is formed on the photosensitive drum 8. Subsequently, the electrostatic latent image on the photosensitive drum 8 is developed by the development device 10, and then, a toner image is formed. Thereby, the image forming operation is completed.

On the other hand, the sheet picked up from the sheet feeding cartridge 3 by the sheet feeding part 11 is conveyed to the image forming part 7 in a timing synchronized with the above-described image forming operation. In the image forming part 7, the above-described toner image is transferred from the photosensitive drum 6 to the sheet S. The sheet S with the transferred toner image is conveyed to a downstream side on the conveying path CP to enter the fixing device 12 and, in the fixing device 12, the toner image is fixed on the sheet S. The sheet S with the fixed toner image is ejected from a downstream end of the conveying path CP to the sheet ejected tray 4.

Next, the toner container 6 will be further described.

An arrow I accordingly shown in FIG. 2 and later indicates an inward side in left and right directions of the toner container 6 (a side approaching the center in the left and right directions of the toner container 6), and an arrow O accordingly shown in FIG. 2 and later indicates an outward side in the left and right directions of the toner container 6 (a side separating from the center in the left and right directions of the toner container 6). An arrow R1 accordingly shown in FIG. 3 and later indicates a first rotating direction (hereinafter, called as a "first rotating direction R1"), and an arrow R2 accordingly shown in FIG. 3 and later indicates a second rotating direction opposite to the first rotating direction R1 (hereinafter, called as a "second rotating direction R2").

Figure 2:
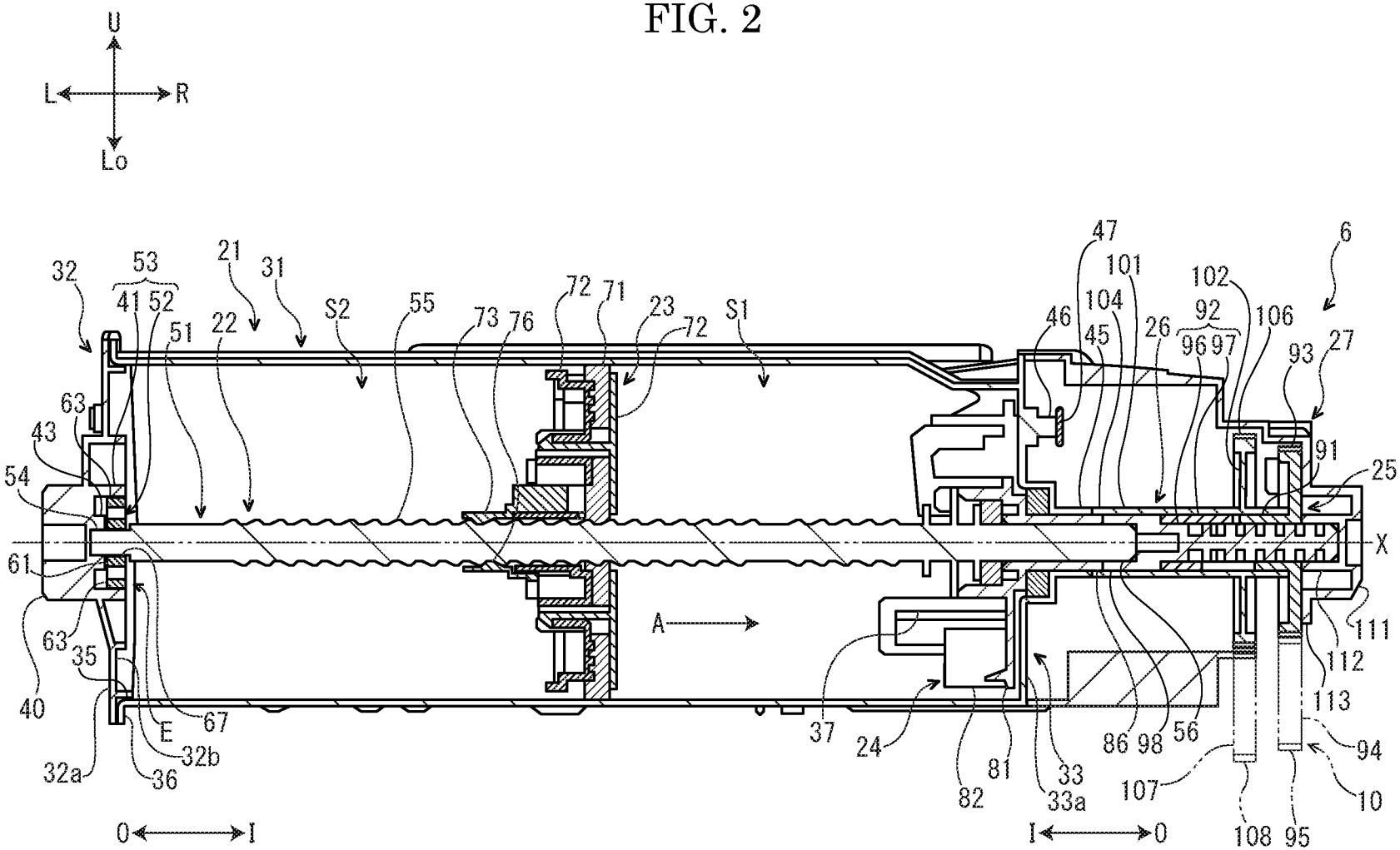
FIG. 2 is a sectional view showing a toner container according to the embodiment of the present disclosure.

With reference to FIG. 2, for the toner container 6, a rotation axis X extended in the left and right directions (an example of one direction) is set. Hereinafter, a simply described "radial direction" indicates a radial direction of a circle around the rotation axis X, and a simply described "circumference direction" indicates a circumference direction around the rotation axis X.

The toner container 6 includes a container body 21, a rotating member 22 arranged at the center of the container body 21, a moving member 23 attached on an outer circumference of the rotating member 22, an agitating member 24 attached to a right end of the container body 21, a transmitting member 25 and a connecting member 26 located at a right side (an outward side in the left and right directions) of the container body 21, and a cover 27 covering the transmitting member 25 and the connecting member 26. Hereinafter, the above-described components of the toner container 6 will be described in order.

With reference to FIG. 2, the container body 21 of the toner container 6 is formed in a box shape long in left and right directions. Inside the container body 21, a first space S1 and a second space S2 are formed. In the first space S1, the toner is contained but, in the second space S2, no toner is contained. The second space S2 is arranged at a left side of the first space S1.

The container body 21 includes a peripheral wall part 31, a lid part 32 arranged at a left side of the peripheral wall part 31, and a side wall part 33 arranged at a right side of the peripheral wall part 31.

The peripheral wall part 31 of the container body 21 is formed in a cylindrical shape and is extended in the left and right directions. In a left end of the peripheral wall part 31, an opening part 35 is provided. On an outer circumference face of the left end of the peripheral wall part 31, an annular flange part 36 is protruded around the opening part 35. In a right end of the peripheral wall part 31, a discharging port 37 discharging the toner is provided. The discharging port 37 is covered by an openable/closable shutter (not shown).

The lid part 32 of the container body 21 is arranged along a flat face orthogonal to the rotation axis X. The lid part 32 is formed separately from the peripheral wall part 31. An outer circumference portion of the lid part 32 is fixed to the flange part 36 of the peripheral wall part 31. The lid part 32 closes the opening part 35 of the peripheral wall part 31. In the center of a left face 32*a* (an outer face) of the lid part 32, a left side protruded portion 40 is protruded.

With reference to FIGS. 2-5, in the center of a right face 32*b* (an inner face) of the lid part 32, an inserted wall 41 is protruded at a back side of the left side protruded portion 40. The inserted wall 41 is formed in an annular shape around the rotation axis X. On an inner circumference face of the inserted wall 41, a pair of step parts 42 are provided. The pair of step parts 42 are arranged at opposite side to each other across the rotation axis X. In the inner circumference face of the inserted wall 41, an upstream side portion P from each step part 42 in the first rotating direction R1 is positioned at an inward side in the radial direction in comparison with a downstream side portion Q from each step part 42 in the first rotating direction R1.

In the center of the right face 32*b* of the lid part 32, a supporting wall 43 is protruded at the back side of the left side protruded portion 40 and inside an inner circumference of the inserted wall 41. The supporting wall 43 is formed in an annular shape around the rotation axis X. A protrusion width in the left and right directions of the supporting wall 43 from the right face 32*b* of the lid part 32 is smaller than a protrusion width in the left and right directions of the inserted wall 41 from the right face 32*b* of the lid part 32.

With reference with FIG. 2, the side wall part 33 is provided along a flat face orthogonal to the rotation axis X. The side wall part 33 is made integrally with the peripheral wall part 31 and covers a right side (an outward side in the left and right directions) of the peripheral wall part 31. In the center of a right face 33*a* (an outer face) of the side wall part 33, a bearing portion 45 is protruded. The bearing portion 45 is formed in a cylindrical shape around the rotation axis X. In an upper part of the right face 33*a* of the side wall part 33, a toner filling port 46 is protruded above the bearing portion 45, and the toner is filled in the first space S1 of the container body 21 via this toner filling port 46. The toner filling port 46 is closed by a cap 47.

Figure 3:
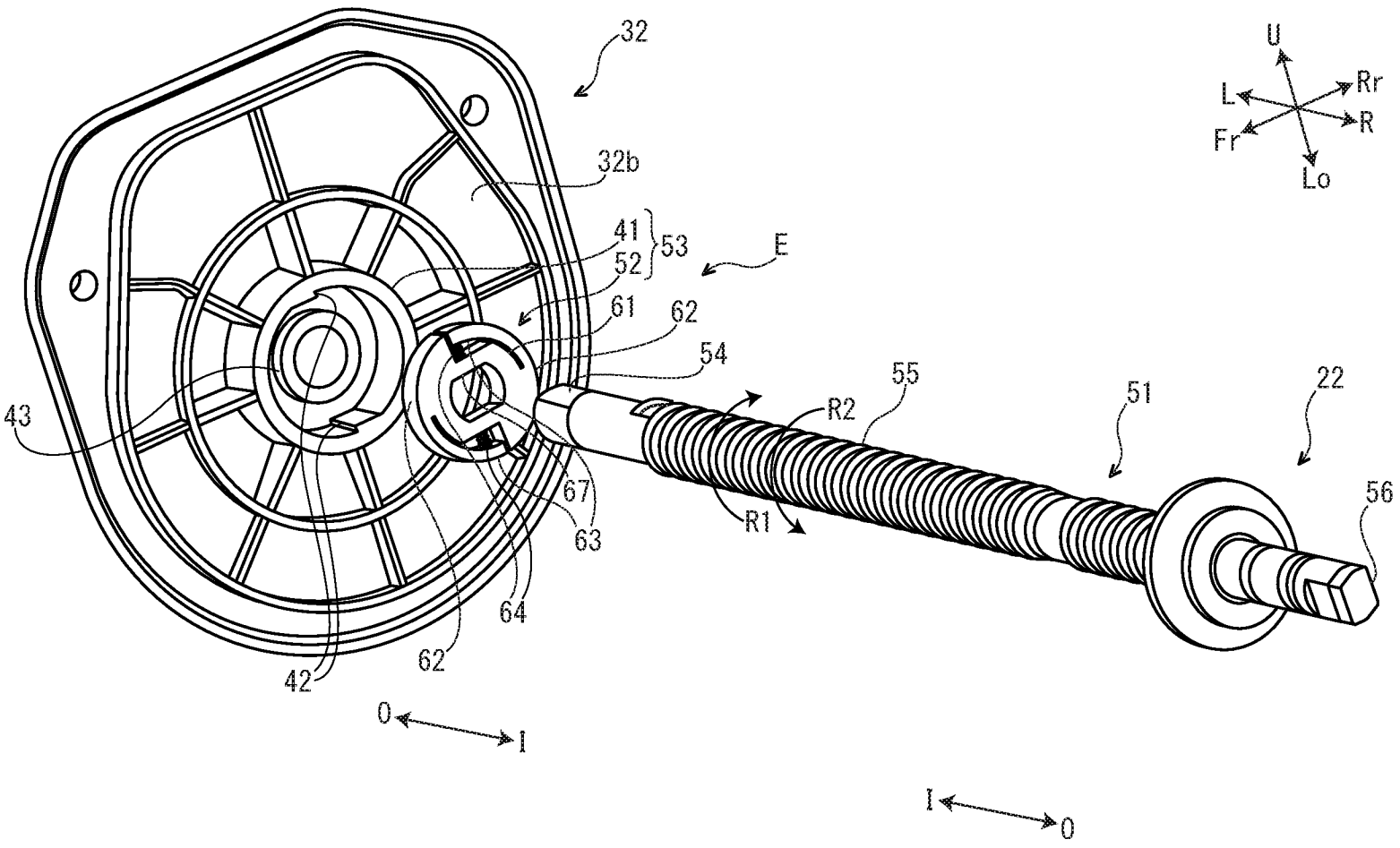
FIG. 3 is an exploded perspective view showing a lid part of a container body and a rotating member in the toner container according to the embodiment of the present disclosure.

With reference to FIGS. 2 and 3, the rotating member 22 is configured to rotate around the rotation axis X. A left end (one end in the left and right directions) of the rotating member 22 is engaged with the right face 32*b* of the lid part 32. A part other than a right end (the other end in the left and right directions) of the rotating member 22 is installed in the container body 21.

The rotating member 22 includes a shaft 51 extended in the left and right directions, and an inserting piece 52 provided on an outer circumference of a left end (one end in the left and right directions) of the shaft 51. The inserting piece 52 together with the inserted wall 41 provided on the right face 32*b* of the lid part 32 composes a restricting mechanism 53. The restricting mechanism 53 is arranged in an engaging part E of the left end of the rotating member 22 and the right face 32*b* of the lid part 32.

The shaft 51 of the rotating member 22 penetrates the peripheral wall part 31 of the container body 21. In a left end (one end in the left and right directions) of the shaft 51, a joint part 54 having an oval shaped (noncircular) section is provided. The joint part 54 is inserted into the supporting wall 43 arranged in the right face 32*b* of the lid part 32, and is rotatably supported by the supporting wall 43. That is, the joint part 54 is engaged with the right face 32*b* of the lid part 32. On an outer circumference face at the center in the left and right directions of the shaft 51, a screw part 55 is provided. A right side portion of the shaft 51 is inserted into the bearing portion 45 arranged in the side wall part 33 of the container body 21.

In a right end (the other end in the left and right directions) of the shaft 51 of the rotating member 22, a following coupling 56 is provided. The following coupling 56 faces to the outside of the container body 21.

With reference to FIGS. 2-5, the inserting piece 52 of the rotating member 22 is inserted into the inserted wall 41 arranged in the right face 32*b* of the lid part 32, and is rotatably supported by the inserted wall 41. That is, the inserting piece 52 is engaged with the right face 32*b* of the lid part 32.

The inserting piece 52 of the rotating member 22 includes an attaching part 61, a pair of protruded parts 62 protruded from the attaching part 61 to an outward side in the radial direction, a pair of arm parts 63 extended from the pair of protruded parts 62 in the circumference direction, and a pair of coil springs 64 (an example of a biasing part) arranged between the attaching part 61 and the pair of arm parts 63. The attaching part 61, the pair of protruded parts 62 and the pair of arm parts 63 are integrally formed.

In the attaching part 61 of the inserting piece 52 of the rotating member 22, a fitted hole 67 having an oval shaped (noncircular) section is provided. In the fitted hole 67, the joint part 54 of the shaft 51 is fitted. Thereby, the attaching part 61 is attached to the joint part 54 of the shaft 51, and the inserting piece 52 is rotatable integrally with the shaft 51. On an outer circumference face of the attaching part 61, a pair of bosses 68 are protruded.

The pair of protruded parts 62 of the inserting piece 52 of the rotating member 22 are arranged at opposite side to each other across the rotation axis X. Each protruded part 62 is provided in an outer circumference portion of the inserting piece 52, and is curved in an arc shape.

The pair of arm parts 63 of the inserting piece 52 of the rotating member 22 are arranged at opposite side to each other across the rotation axis X. Each arm part 63 is provided in an outer circumference portion of the inserting piece 52, and is curved in an arc shape. A proximal end (a downstream side end in the first rotating direction R1) of each arm part 63 is connected with each protruded part 62. A distal end (an upstream side end in the first rotating direction R1) of each arm part 63 is not connected with each protruded part 62, and is a free end. Therefore, each arm part 63 is provided so as to be elastically deformable in the radial direction with the proximal end as a fulcrum.

The pair of coil springs 64 of the inserting piece 52 of the rotating member 22 are arranged at opposite side to each other across the rotation axis X. One end in an axis direction (an end at an inward side in the radial direction) of each coil spring 64 is attached to an outer circumference of each boss of the attaching part 61 and is in contact with the outer circumference face of the attaching part 61. The other end in the axis direction (an end at an outward side in the radial direction) of each coil spring 64 is in contact with an inner circumference face of each arm part 63. Each coil spring biases each arm part 63 to an outward side in the radial direction (refer to arrows Y in FIGS. 4 and 5).

With reference to FIG. 2, the moving member 23 of the toner container 6 partitions a space inside the container body 21 into the first space S1 and the second space S2 in the left and right directions. The moving member 23 is provided so as to be linearly movable in the left and right directions in a state that rotation of the moving member 23 is restricted.

The moving member 23 includes a seal piece 71, a pair of left and right sandwiching pieces 72 sandwiching the seal piece 71, and an engaging piece 73 located at a left side of the left sandwiching piece 72. An outer circumference face of the seal piece 71 is in contact with an inner circumference face of the peripheral wall part 31 of the container body 21. On an inner circumference face of the engaging piece 73, a screw groove 76 is provided. The screw groove 76 is engaged with the screw part 55 provided on the shaft 51 of the rotating member 22. Thereby, rotation of the rotating member 22 can be converted to linear movement of the moving member 23 so as to be linearly movable in the left and right directions.

With reference to FIG. 2, the agitating member 24 is relative-rotatably attached to the outer circumference of the rotating member 22. The agitating member 24 is configured to rotate around the rotation axis X. The agitating member 24 includes a holding piece 81, and a film 82 held by the holding piece 81.

In the holding piece 81 of the agitating member 24, the right side portion of the shaft 51 is inserted. Thereby, the holding piece 81 supports the right side portion of the shaft 51 rotatably. A left side portion of the holding piece 81 is installed in a right end of the first space S1 of the container body 21.

A right side portion of the holding piece 81 of the agitating member 24 is inserted into the bearing portion 45 provided in the side wall part 33 of the container body 21. Thereby, the agitating member 24 is rotatably supported by the side wall part 33 of the container body 21.

In a right end of the holding piece 81 of the agitating member 24, an agitating coupling 86 is provided. The agitating coupling 86 faces to the outside of the container body 21.

The film 82 of the agitating member 24 is installed in the right end of the first space S1 of the container body 21. The film 82 is made of, for example, a resin film, such as a PET film (Polyethylene Terephthalate Film), and has flexibility. A position in the left and right directions of the film 82 is overlapped with a position in the left and right directions of the discharging port 37 provided in the peripheral wall part 31 of the container body 21.

With reference to FIG. 2, the whole of the transmitting member 25 of the toner container 6 is arranged outside the container body 21. The transmitting member 25 includes a transmitting piece 91, and a ratchet mechanism 92 connecting the transmitting piece 91 and the rotating member 22.

A left side portion of the transmitting piece 91 of the transmitting member 25 is formed in a cylindrical shape around the rotation axis X. On an outer circumference portion of a right side portion of the transmitting piece 91, a transmitting gear 93 is provided. The transmitting gear 93 is connected to a first driving gear 95 of a first driving member 94 provided in the developing device 10.

The ratchet mechanism 92 of the transmitting member 25 includes a ratchet shaft 96, and a ratchet piece 97 provided on an outer circumference of the ratchet shaft 96.

The ratchet shaft 96 of the ratchet mechanism 92 of the transmitting member 25 is extended in the left and right directions. In a left end of the ratchet shaft 96, a transmitting coupling 98 is provided. The transmitting coupling 98 is connected to the following coupling 56 provided in the shaft 51 of the rotating member 22. Thereby, the transmitting member 25 is linearly connected to the rotating member 22, and the transmitting member 25 and the rotating member 22 are integrally rotated around the rotation axis X.

The ratchet piece 97 of the ratchet mechanism 92 of the transmitting member 25 is formed in a cylindrical shape around the rotation axis X. The ratchet piece 97 is arranged between the transmitting piece 91 and the ratchet shaft 96.

With reference to FIG. 2, the whole of the connecting member 26 of the toner container 6 is arranged outside the container body 21. The connecting member 26 includes a cylindrical part 101, and an annular part 102 protruded from an outer circumference face of a right side portion of the cylindrical part 101.

The cylindrical part 101 of the connecting member 26 is formed in a cylindrical shape around the rotation axis X. In a left end of the cylindrical part 101, a connecting coupling 104 is provided. The connecting coupling 104 is connected to the agitating coupling 86 provided in the holding piece 81 of the agitating member 24. Thereby, the connecting member 26 is linearly connected to the agitating member 24, and the connecting member 26 and the agitating member 24 are integrally rotated around the rotation axis X.

The annular part 102 of the connecting member 26 is formed in an annular shape around the rotation axis X. On an outer circumference face of the annular part 102, a connecting gear 106 is provided. The connecting gear 106 is connected to a second driving gear 108 of a second driving member 107 provided in the developing device 10.

With reference to FIG. 2, the cover 27 of the toner container 6 is attached to the right end of the container body 21. The cover 27 covers a right side (an outward side in the left and right directions) of the side wall part 33 of the container body 21.

On a right face (an outer face) of the cover 27, a right side protruded portion 111 is protruded. On a left face (an inner face) of the cover 27, a bearing portion 112 is provided at a back side of the right side protruded portion 111. The bearing portion 112 is formed in a cylindrical shape around the rotation axis X. The bearing portion 112 supports a right end of the ratchet shaft 96 of the ratchet mechanism 92 rotatably. In a lower part of the cover 27, a window portion 113 is provided, and parts of the transmitting gear 93 and the connecting gear 106 are exposed to the outside of the toner container 6 via the window portion 113.

Next, operation replenishing the toner from the toner container 6 to the developing device 10 (hereinafter, called as "toner replenishing operation") will be described.

When the toner replenishing operation is executed, a drive source (not shown) rotates the second driving member 107. When the second driving member 107 is thus rotated, this rotation is transmitted to the agitating member 24 by the connecting member 26 to rotate the agitating member 24. Thereby, the film 82 of the agitating member 24 agitates the toner contained in the first space S1 of the container body 21 and conveys this toner to the discharging port 37. The toner thus conveyed to the discharging port 37 is discharged to the outside of the container body 21 via the discharging port 37 and is replenished to the developing device 10. Thereby, the toner replenishing operation is completed.

After the toner replenishing operation as described above is executed, the toner near the discharging port 37 in the first space S1 of the container body 21 is decreased. According to this, if a toner sensor (not shown) senses that the toner near the discharging port 37 becomes less than a predetermined threshold value, a drive source (not shown) rotates the first driving member 94. When the first driving member 94 is thus rotated, this rotation is transmitted to the rotating member 22 by the transmitting member 25 to rotate the rotating member 22 in the first rotating direction R1. When the rotating member 22 is thus rotated in the first rotating direction R1, the moving member 23 attached on the outer circumference of the rotating member 22 is moved to the right side in the left and right directions (a side approaching the discharging port 37), as indicated by an arrow A in FIG. 2. According to this, a toner quantity in the first space S1 of the container body 21 is decreased, and then, the toner in the first space S1 of the container body 21 is pushed by the moving member 23 and moved to the right side (the side approaching the discharging port 37). That is, the moving member 23 conveys the toner in the container body 21 to the discharging port 37. Therefore, the toner is filled up in a space near the discharging port 37 again, and then, it is possible to replenish a sufficient quantity of the toner from the toner container 6 to the developing device 10 in next toner replenishing operation.

Incidentally, in the toner container 6 configured as described above, if a user rotates the rotating member in the second rotating direction R2 by mistake, the moving member 23 may be moved to the left side (a side separating from the discharging port 37). If such situation is caused, it is feared that distribution of the toner in the container body 21 is varied, a stable quantity of the toner cannot be discharged from the discharging port 37, and toner replenishment from the toner container 6 to the developing device 10 becomes unstable. Thereupon, in the present embodiment, the rotating member 22 is restricted from rotating in the second rotating direction R2, as follows.

When the toner replenishing operation is executed, if the transmitting piece 91 of the transmitting member 25 is rotated in the first rotating direction R1, the ratchet piece 97 and the ratchet shaft 96 of the ratchet mechanism 92 of the transmitting member 25 is rotated in the first rotating direction R1 together with the transmitting piece 91. Therefore, the rotating member 22 connected to the ratchet shaft 96 is rotated in the first rotating direction R1 together with the ratchet shaft 96 in a body. Thus, rotation of the transmitting piece 91 is transmitted to the rotating member 22 by the ratchet mechanism 92 to rotate the rotating member 22 in the first rotating direction R1.

On the other hand, if the transmitting piece 91 of the transmitting member 25 is rotated in the second rotating direction R2, the ratchet piece 97 of the ratchet mechanism 92 of the transmitting member 25 is rotated in the second rotating direction R2 together with the transmitting piece 91, but the ratchet shaft 96 of the ratchet mechanism 92 of the transmitting member 25 is not rotated. That is, the ratchet piece 97 is raced with respect to the ratchet shaft 96. Therefore, the rotating member 22 connected to the ratchet shaft 96 is not rotated. Thus, by the ratchet mechanism 92, transmission of rotation from the transmitting piece 91 to the rotating member 22 is intercepted, and then, rotation of the rotating member 22 in the second rotating direction R2 is restricted.

As described above, in the present embodiment, rotation of the rotating member 22 in the second rotating direction R2 is restricted by the ratchet mechanism 92. However, in a case where the user directly makes the rotating member 22 rotate in the second rotating direction R2, because the ratchet mechanism 92 does not work, it is feared that rotation of the rotating member 22 in the second rotating direction R2 cannot be restricted. That is, it is feared that only the ratchet mechanism 92 cannot certainly restrict rotation of the rotating member 22 in the second rotating direction R2. Thereupon, in the present embodiment, the rotating member 22 is certainly restricted from rotating in the second rotating direction R2, as follows.

Figure 4:
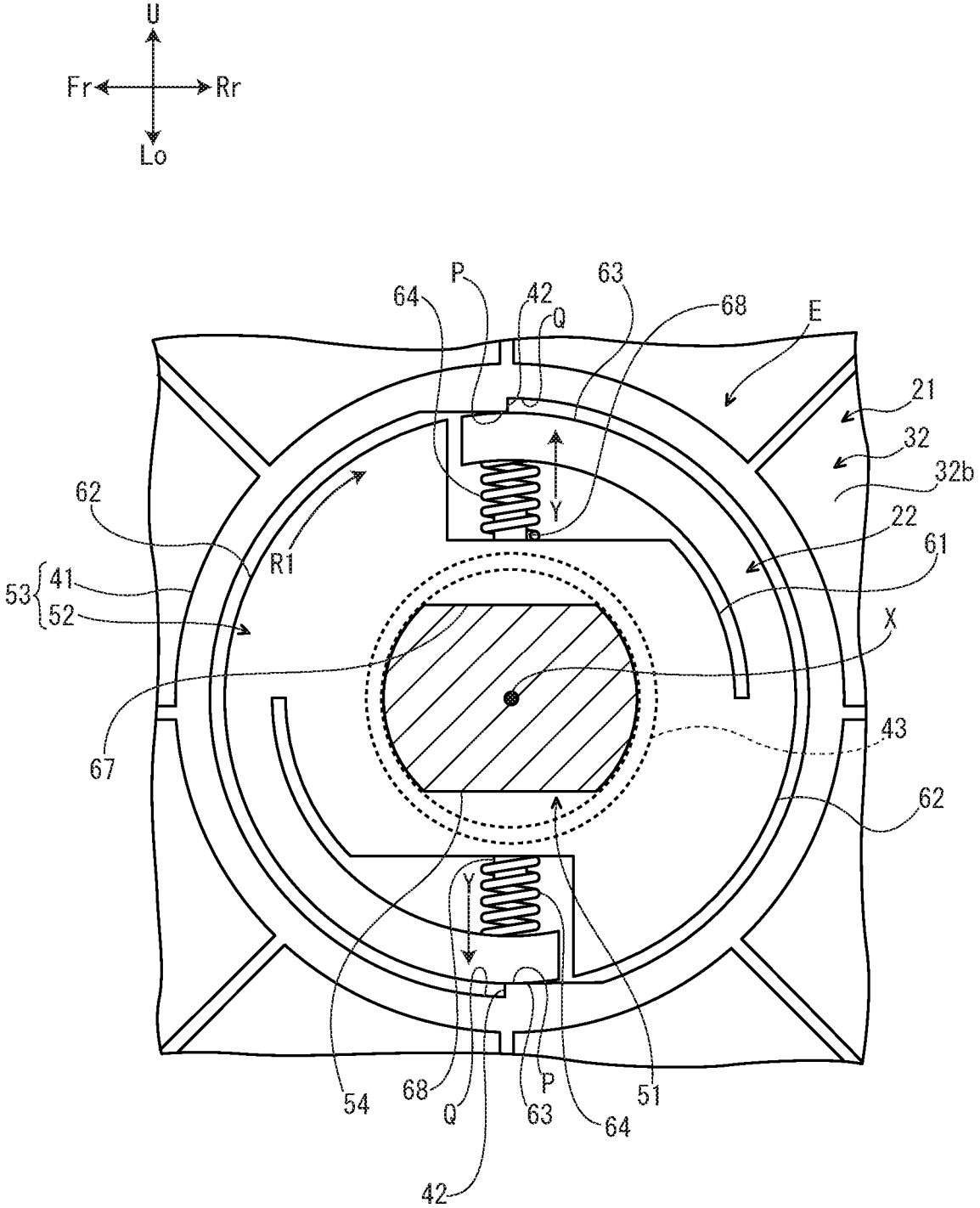
FIG. 4 is a sectional view showing the toner container, in a state that a distal end of each arm part is not engaged with each step part, according to the embodiment of the present disclosure.

With reference to FIG. 4, when the toner replenishing operation is executed, in a case where the rotating member 22 is rotated in the first rotating direction R1, since the distal end of each arm part 63 of the inserting piece 52 is not engaged with each step part of the inserted wall 41, rotation of the rotating member 22 in the first rotating direction R1 is allowed. That is, by the restricting mechanism 53 composed of the inserted wall 41 and the inserting piece 52, rotation of the rotating member 22 in the first rotating direction R1 is allowed.

Figure 5:
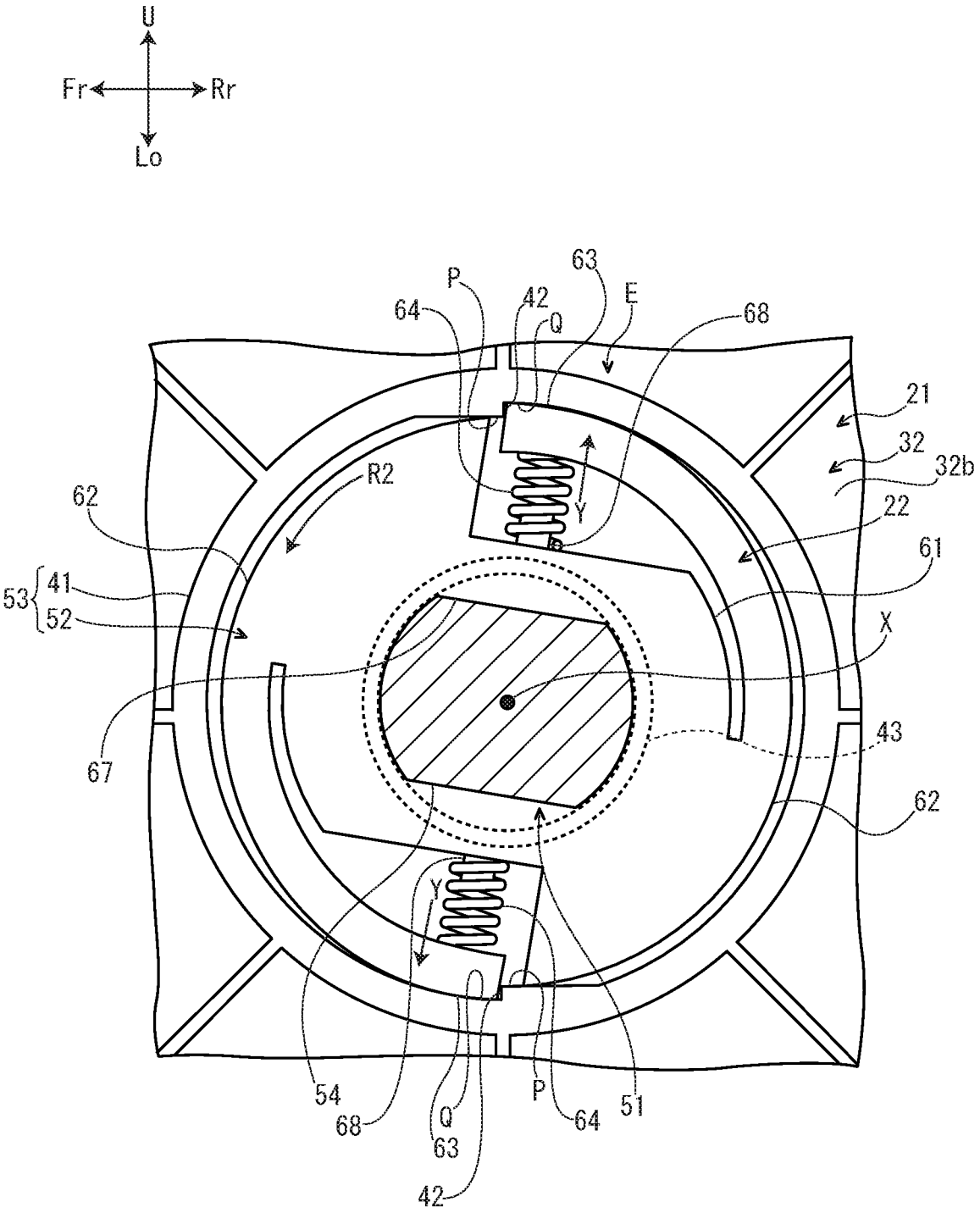
FIG. 5 is a sectional view showing the toner container, in a state that the distal end of each arm part is engaged with each step part, according to the embodiment of the present disclosure.

On the other hand, with reference to FIG. 5, in a case where the user directly makes the rotating member 22 rotate in the second rotating direction R2, since the distal end of each arm part 63 of the inserting piece 52 is engaged with each step part 42 of the inserted wall 41, rotation of the rotating member 22 in the second rotating direction R2 is restricted. That is, by the restricting mechanism 53 composed of the inserted wall 41 and the inserting piece 52, rotation of the rotating member 22 in the second rotating direction R2 is restricted.

In the present embodiment, the restricting mechanism 53 for allowing rotation of the rotating member in the first rotating direction R1 and restricting rotation of the rotating member 22 in the second rotating direction R2 opposite to the first rotating direction R1 is provided in the engaging part E of the left end of the rotating member 22 and the right face 32*b* of the lid part 32. By applying such a configuration, in a case where the user directly makes the rotating member 22 rotate in the second rotating direction R2, it is possible to certainly restrict rotation of the rotating member 22 in the second rotating direction R2.

In addition, the restricting mechanism 53 is composed of the inserted wall 41 of the lid part 32 and the inserting piece 52 and of the rotating member 22. By applying such a configuration, it is possible to achieve assembly of the restricting mechanism 53 only by inserting the inserting piece 52 into the inserted wall 41. Therefore, it is facilitate assembly of the restricting mechanism 53.

Moreover, each arm part 63 provided in the outer circumference portion of the inserting piece 52 is engaged with each step part 42 provided on the inner circumference face of the inserted wall 41, and thereby, rotation of the rotating member 22 in the second rotating direction R2 is restricted. By applying such a configuration, it is possible to certainly restrict rotation of the rotating member 22 in the second rotating direction R2 by using a simple configuration.

Further, each arm part 63 is biased to the outward side in the radial direction by each coil spring 64. By applying such a configuration, it is possible to certainly engage each arm part 63 with each step part 42, and to more certainly restrict rotation of the rotating member 22 in the second rotating direction R2.

Furthermore, each arm part 63 is extended in the circumference direction from each protruded part 62. By applying such a configuration, it is possible to make each arm part 63 arrange along the inner circumference face of the inserted wall 41, and to smoothly rotate the rotating member 22 in the first rotating direction R1.

Moreover, the joint part 54 provided in the left end of the shaft 51 is supported by the supporting wall 43 of the lid part 32. By applying such a configuration, it is possible to directly support the shaft 51 by the lid part 32, and to restrain wobbling of the shaft 51 when the rotating member 22 is rotated in the rotating direction R1.

Further, the restricting mechanism 53 is provided in the engaging part E of the left end of the rotating member 22 and the right face 32*b* of the lid part 32, and the lid part 32 is fixed to the left end of the peripheral wall part 31. By applying such a configuration, it is possible to fix the lid part 32 to the left end of the peripheral wall part 31 while visually confirming that the restricting mechanism 53 is correctly assembled. Therefore, it is possible to facilitate assembly of the toner container 6.

Furthermore, the image forming apparatus 1 includes the above-described toner container 6, the developing device 10 to which the toner container 6 is detachably attached. By applying such a configuration, it is possible to provide the image forming apparatus 1 including the toner container 6 being capable of certainly restricting rotation of the rotating member 22 in the second rotating direction R2.

In the present embodiment, the restricting mechanism 53 is provided in the engaging part E of the rotating member 22 and the inner face of the lid part 32. However, in another embodiment, the restricting mechanism 53 may be provided in the engaging part E of the rotating member 22 and an inner face of the side wall part 33.

In the present embodiment, a part (a part other than the right end) of the rotating member 22 is installed in the container body 21. However, in another embodiment, the whole of the rotating member 22 may be installed in the container body 21.

In the present embodiment, the toner container 6 is detachably attached to the developing device 10. However, in another embodiment, the toner container 6 may be detachably attached to a member other than the developing device 10 (e.g. the apparatus body 2).

In the present embodiment, the image forming apparatus 1 is the printer. However, in another embodiment, the image forming apparatus 1 may be a copying machine, a facsimile, a multifunction peripheral (an image forming apparatus compositely including a print function, a copy function, a facsimile function and others) or the like.

The above-description of the embodiment of the present disclosure was described about a preferable embodiment of the toner container and the image forming apparatus according to the disclosure. However, the technical scope of the present disclosure is not limited to the embodiments.

The invention claimed is:

1. A toner container comprising:

a container body having a discharging port discharging a toner and containing the toner;

a rotating member engaged with an inner face of the container body, and rotated around a rotation axis extended in one direction, wherein at least a part of the rotating member being installed in the container body;

a moving member attached to the rotating member inside the container body, coming into contact with an inner circumference face of a peripheral wall part of the container body, moved in the one direction in accordance with rotation of the rotating member, and conveying the toner in the container body to the discharging port; and a restricting mechanism provided in an engaging part of the rotating member and an inner face of the container body inside the container body, wherein the restricting mechanism allows rotation of the rotating member in a first rotating direction, and restricts rotation of the rotating member in a second rotating direction opposite to the first rotating direction, on the inner face of the container body, an inserted wall is protruded, the rotating member includes:

a shaft extended in the one direction; and an inserting piece provided on an outer circumference of an end in the one direction of the shaft, and inserted into the inserted wall, the restricting mechanism is composed of the inserted wall and the inserting piece, on an inner circumference face of the inserted wall, a pair of step parts are provided, on an outer circumference portion of the inserting piece, a pair of arm parts is provided, and each of the arm parts is engaged with each of the step parts, and thereby, rotation of the rotating member in the second rotating direction is restricted.

2. The toner container according to claim 1, wherein each arm part is provided so as to be elastically deformable in a radial direction of a circle around the rotation axis, the inserting piece includes a biasing part biasing each arm part to an outward side in the radial direction of the circle around the rotation axis.

3. An image forming apparatus comprising:

the toner container according to claim 2; and an attached member to which the toner container is detachably attached.

4. The toner container according to claim 1, wherein the inserting piece includes:

an attaching part attached to the end in the one direction of the shaft; and a protruded part protruded from the attaching part to an outward side in a radial direction of a circle around the rotation axis, each arm part is extended from the protruded part in a circumference direction around the rotation axis.

5. An image forming apparatus comprising:

the toner container according to claim 4; and an attached member to which the toner container is detachably attached.

6. The toner container according to claim 1, wherein on the inner face of the container body, a supporting wall is protruded inside an inner circumference of the inserted wall, the end in the one direction of the shaft is supported by the supporting wall.

7. An image forming apparatus comprising:

the toner container according to claim 6; and an attached member to which the toner container is detachably attached.

8. The toner container according to claim 1, wherein the container body includes:

a peripheral wall extended in the one direction and having an opening part at an end in the one direction of the peripheral wall; and a lid part fixed to the end in the one direction of the peripheral wall and closing the opening part, the rotating member is engaged with an inner face of the lid part, the restricting mechanism is provided in an engaging part of the rotating member and the inner face of the lid part.

9. An image forming apparatus comprising:

the toner container according to claim 8; and an attached member to which the toner container is detachably attached.

10. The toner container according to claim 1, wherein the moving member partitions a space inside the container body into a first space at one end side in the one direction and a second space at the other end side in the one direction, the discharging port is provided at the one end side in the container body, the moving member is moved to the one end side in accordance with rotation of the rotating member in the first rotating direction.

11. An image forming apparatus comprising:

the toner container according to claim 10; and an attached member to which the toner container is detachably attached.

12. An image forming apparatus comprising:

the toner container according to claim 1; and an attached member to which the toner container is detachably attached.

* * * * *